US008992283B2

(12) United States Patent
Piwko, Jr. et al.

(10) Patent No.: US 8,992,283 B2
(45) Date of Patent: Mar. 31, 2015

(54) ENTERTAINMENT DEVICE WITH MODE INDICATOR

(75) Inventors: Robert D. Piwko, Jr., Hamburg, NY (US); John F. Rhein, Hamburg, NY (US); Michael Thomas Kane, Fairport, NY (US)

(73) Assignee: Mattel, Inc., El Segundo, CA (US)

( * ) Notice: Subject to any disclaimer, the term of this patent is extended or adjusted under 35 U.S.C. 154(b) by 2248 days.

(21) Appl. No.: 11/847,896

(22) Filed: Aug. 30, 2007

(65) Prior Publication Data

US 2008/0012406 A1 Jan. 17, 2008

Related U.S. Application Data

(63) Continuation of application No. 10/718,565, filed on Nov. 24, 2003, now abandoned.

(60) Provisional application No. 60/466,735, filed on May 1, 2003.

(51) Int. Cl.

| | |
|---|---|
| ***A63H 33/06*** | (2006.01) |
| ***A47D 13/10*** | (2006.01) |
| ***A47D 15/00*** | (2006.01) |

(52) U.S. Cl.

CPC ..... *A47D 13/107* (2013.01); *A47D 15/00* (2013.01)

USPC ..... 446/227; 446/130; 446/282

(58) Field of Classification Search

None

See application file for complete search history.

(56) References Cited

U.S. PATENT DOCUMENTS

| | | | | |
|---|---|---|---|---|
| 704,774 | A | | 7/1902 | Blackledge |
| 2,110,381 | A | | 3/1938 | Lohr |
| 2,402,861 | A | | 6/1946 | Winnick |
| 2,460,308 | A | | 2/1949 | Pribil |
| 2,848,040 | A | | 8/1958 | Chernivsky |
| 2,981,315 | A | | 4/1961 | Schaffer |
| 3,017,220 | A | | 1/1962 | Chernivsky |
| 3,110,519 | A | | 11/1963 | Chernivsky |
| 3,114,216 | A | | 12/1963 | Crawford et al. |
| 3,235,306 | A | | 2/1966 | Chernivsky |
| 3,261,033 | A | | 7/1966 | Martin |
| 3,388,499 | A | | 6/1968 | Mercorelli |
| 3,400,366 | A | * | 9/1968 | Downing ..... 340/932.1 |
| 3,538,522 | A | | 11/1970 | Adams |
| 3,789,218 | A | | 1/1974 | Blount |
| 4,067,128 | A | * | 1/1978 | Kempster ..... 40/473 |
| 4,081,869 | A | | 4/1978 | Ash |
| 4,174,833 | A | * | 11/1979 | Hennig et al. ..... 273/442 |
| 4,188,678 | A | | 2/1980 | Rawolle |
| 4,215,511 | A | | 8/1980 | Todokoro |
| 4,261,571 | A | * | 4/1981 | Ito ..... 273/143 R |
| 4,404,865 | A | | 9/1983 | Kim |
| 4,536,164 | A | * | 8/1985 | Klawitter ..... 446/143 |

(Continued)

FOREIGN PATENT DOCUMENTS

| | | |
|---|---|---|
| EP | 0028992 | 5/1981 |
| EP | 0995382 | 4/2000 |

(Continued)

*Primary Examiner* — Tramar Harper

(74) *Attorney, Agent, or Firm* — Edell, Shapiro & Finnan, et al.

(57) ABSTRACT

This present invention relates generally to an infant seat and, in particular, to an infant seat that provides a stable, enhanced seating position for an infant and includes a sensory stimulus unit with a slide switch that, when actuated, effectuates a change in visual appearance of the stimulus unit and a corresponding change in the sensory output.

20 Claims, 15 Drawing Sheets

(56) References Cited

U.S. PATENT DOCUMENTS

| | | | | | |
|---|---|---|---|---|---|
| 4,540,219 | A | | 9/1985 | Klinger | |
| 4,553,786 | A | | 11/1985 | Lockett, III et al. | |
| D282,791 | S | | 3/1986 | Lockett, III et al. | |
| 4,594,072 | A | * | 6/1986 | Cowell | 446/227 |
| 4,681,096 | A | | 7/1987 | Cuervo | |
| D297,685 | S | | 9/1988 | Wilson | |
| 4,799,890 | A | | 1/1989 | Thompson et al. | |
| 5,032,099 | A | | 7/1991 | Chan | |
| 5,078,019 | A | | 1/1992 | Aoki | |
| 5,172,955 | A | | 12/1992 | Freese et al. | |
| 5,187,826 | A | | 2/1993 | Mariol | |
| 5,203,611 | A | | 4/1993 | Greenwood | |
| 5,207,478 | A | | 5/1993 | Freese et al. | |
| D337,894 | S | | 8/1993 | Mariol | |
| 5,269,591 | A | | 12/1993 | Miga, Jr. et al. | |
| D343,958 | S | | 2/1994 | Greenwood | |
| 5,310,377 | A | | 5/1994 | Joja | |
| 5,312,284 | A | | 5/1994 | Grober et al. | |
| 5,360,258 | A | | 11/1994 | Alivizatos | |
| 5,411,315 | A | | 5/1995 | Greenwood | |
| 5,451,095 | A | | 9/1995 | Riback | |
| 5,460,430 | A | | 10/1995 | Miga, Jr. et al. | |
| 5,503,458 | A | | 4/1996 | Petrie | |
| 5,507,564 | A | | 4/1996 | Huang | |
| 5,509,721 | A | | 4/1996 | Huang | |
| 5,525,142 | A | * | 6/1996 | Yamauchi et al. | 84/602 |
| 5,575,530 | A | | 11/1996 | Harper et al. | |
| 5,615,428 | A | | 4/1997 | Li | |
| 5,617,594 | A | | 4/1997 | Chien | |
| 5,695,345 | A | | 12/1997 | Weiner et al. | |
| 5,863,097 | A | | 1/1999 | Harper et al. | |
| 5,944,574 | A | | 8/1999 | Small et al. | |
| 5,951,360 | A | | 9/1999 | Fearon et al. | |
| 6,071,124 | A | | 6/2000 | Ang et al. | |
| 6,104,313 | A | * | 8/2000 | Boyd, II | 340/908.1 |
| 6,113,455 | A | | 9/2000 | Whelan et al. | |
| 6,116,983 | A | | 9/2000 | Long et al. | |
| 6,150,957 | A | * | 11/2000 | Henz et al. | 340/908 |
| 6,257,659 | B1 | | 7/2001 | Wilkins et al. | |
| 6,332,824 | B2 | | 12/2001 | Tell et al. | |
| 6,341,816 | B1 | | 1/2002 | Chen et al. | |
| 6,361,106 | B1 | | 3/2002 | Huang | |
| 6,377,780 | B2 | | 4/2002 | Greenberg | |
| 6,378,940 | B1 | | 4/2002 | Longoria et al. | |
| D461,854 | S | | 8/2002 | Myers | |
| 6,431,646 | B1 | | 8/2002 | Longoria | |
| 6,464,594 | B1 | | 10/2002 | Canna et al. | |
| D467,285 | S | | 12/2002 | Myers | |
| D468,544 | S | | 1/2003 | Myers | |
| 6,592,425 | B2 | | 7/2003 | Bapst et al. | |
| 6,616,237 | B2 | | 9/2003 | Sonner et al. | |
| 6,652,382 | B1 | * | 11/2003 | Karussi et al. | 463/30 |
| 6,739,649 | B2 | | 5/2004 | Kelly et al. | |
| 6,759,961 | B2 | | 7/2004 | Fitzgerald et al. | |
| 7,156,735 | B2 | * | 1/2007 | Brosnan et al. | 463/16 |
| 2002/0002741 | A1 | | 1/2002 | Tomas et al. | |
| 2002/0020300 | A1 | * | 2/2002 | Koncelik, Jr. | 99/285 |
| 2002/0066652 | A1 | | 6/2002 | Lee | |
| 2002/0140260 | A1 | | 10/2002 | Osato | |
| 2002/0171559 | A1 | * | 11/2002 | Yang | 340/825.69 |
| 2003/0020317 | A1 | | 1/2003 | Keegan et al. | |
| 2003/0022592 | A1 | | 1/2003 | Wood et al. | |
| 2003/0034685 | A1 | | 2/2003 | Sonner et al. | |
| 2003/0067391 | A1 | * | 4/2003 | Fitzgerald et al. | 340/573.1 |
| 2003/0129572 | A1 | | 7/2003 | Shuler et al. | |
| 2004/0077276 | A1 | * | 4/2004 | Fondin et al. | 446/369 |
| 2004/0217643 | A1 | * | 11/2004 | Piwko et al. | 297/452.13 |
| 2004/0266314 | A1 | * | 12/2004 | Dubois et al. | 446/297 |
| 2005/0124405 | A1 | * | 6/2005 | Nordman | 463/20 |

FOREIGN PATENT DOCUMENTS

| | | |
|---|---|---|
| FR | 2775427 | 3/1999 |
| GB | 2279265 | 1/1995 |
| GB | 2290596 | 1/1996 |
| JP | 2002262967 | 9/2002 |

* cited by examiner

ENTERTAINMENT DEVICE WITH MODE INDICATOR

CROSS REFERENCE TO RELATED APPLICATIONS

This application is a continuation of U.S. Nonprovisional application Ser. No. 10/718,565, entitled "Infant Seat" and filed on 24 Nov. 2003, which is a nonprovisional of U.S. Provisional Application No. 60/466,735, entitled "Entertainment Device with Slide Switch" and filed 1 May 2003. The disclosures of both above-mentioned applications are hereby incorporated by reference in their entireties.

This application is also related to a Design Application Ser. No. 29/194,276, filed 24 Nov. 2003 and entitled "Infant Seat, ", now Pat. No. D492851.

FIELD OF THE INVENTION

This invention relates generally to an infant seat, and in particular, to an infant seat that provides a stable, enhanced seating position for an infant and includes a sensory stimulus unit with a slide switch that, when actuated, effectuates a change in visual appearance of the stimulus unit and a corresponding change in the sensory output.

BACKGROUND OF THE INVENTION

Infant seats have been generally found to be relatively effective for comfortably and securely supporting infants in a seated position. Such seats include bouncer-type seats which are generally formed from a wire frame having a base frame including a main portion adapted to receive and support a seat on a supporting surface and a pair of angular members that extend angularly upwardly and rearward from a front end of the main portion. Such bouncer seats also generally include leg and back frame portions that are supported by the angular frame members and a fabric cover that extends over the leg and back frame members for supporting an infant thereon. The angular members of the base frame are normally resiliently deflectable slightly downward toward the main portion of the base frame thereof. When an infant is supported by the fabric covering the leg and back frame members of a seat of this type, the infant can be gently rocked (bounced) in the seat by the moving the back and leg frame members slightly up and down so that the angular members are slightly resiliently bent downwardly and then resiliently moved upwardly.

Existing infant bouncer-type seats have been generally effective at bouncing an infant and supporting the infant in an upright/seated position. However, such seats have not had deep pockets in which an infant can sit and thus provide a more secure and stable setting in which an infant can sit.

Free-standing infant seats are particularly useful to parents for soothing or entertaining an infant or providing an infant with an upright view of a room or surroundings, apart from being held by the parent. The need exists for an infant seat that can provide a broader, deeper, more stable seat for the infant.

Visual appearance and music have particular effects on infants and parents, for example, a cheery face or lively music can energize an infant or his/her parent, while quiet music and a less visually stimulating appearance can soothe or calm an infant, and in turn, his/her parent. The need exists for a sensory stimulus unit that includes a switch that can effectuate a change in visual appearance and a corresponding change in the sensory output to entertain a user.

SUMMARY OF THE INVENTION

Generally, an infant seat can be used to soothe and/or entertain an infant in addition to securely holding the infant in an upright, seated position, thus freeing a parent or caregiver's hands/arms. An infant seat can bounce, vibrate, play music, or any combination thereof. In conjunction with an infant seat according to the present invention, a sensory stimulus unit with a slide switch can, when actuated, effectuate a change in the visual appearance of the sensory stimulus unit and a corresponding change in the sensory output, i.e., such as an audio output.

The details of one or more embodiments of the present invention are set forth in the accompanying drawings and the description below. Other features and advantages of the present invention will be apparent from the description, drawings, and from the claims.

BRIEF DESCRIPTION OF THE DRAWINGS

FIG. 24 is a close-up top view of the ball disposed within the sensory stimulus unit housing. FIG. 25 is a top perspective view of the ball and the interior of the sensory stimulus unit housing. FIG. 26 is a side perspective view of the ball and the interior of the sensory stimulus unit housing.

Like reference symbols in the various drawings indicate like elements.

DETAILED DESCRIPTION OF THE INVENTION

Figure 1:
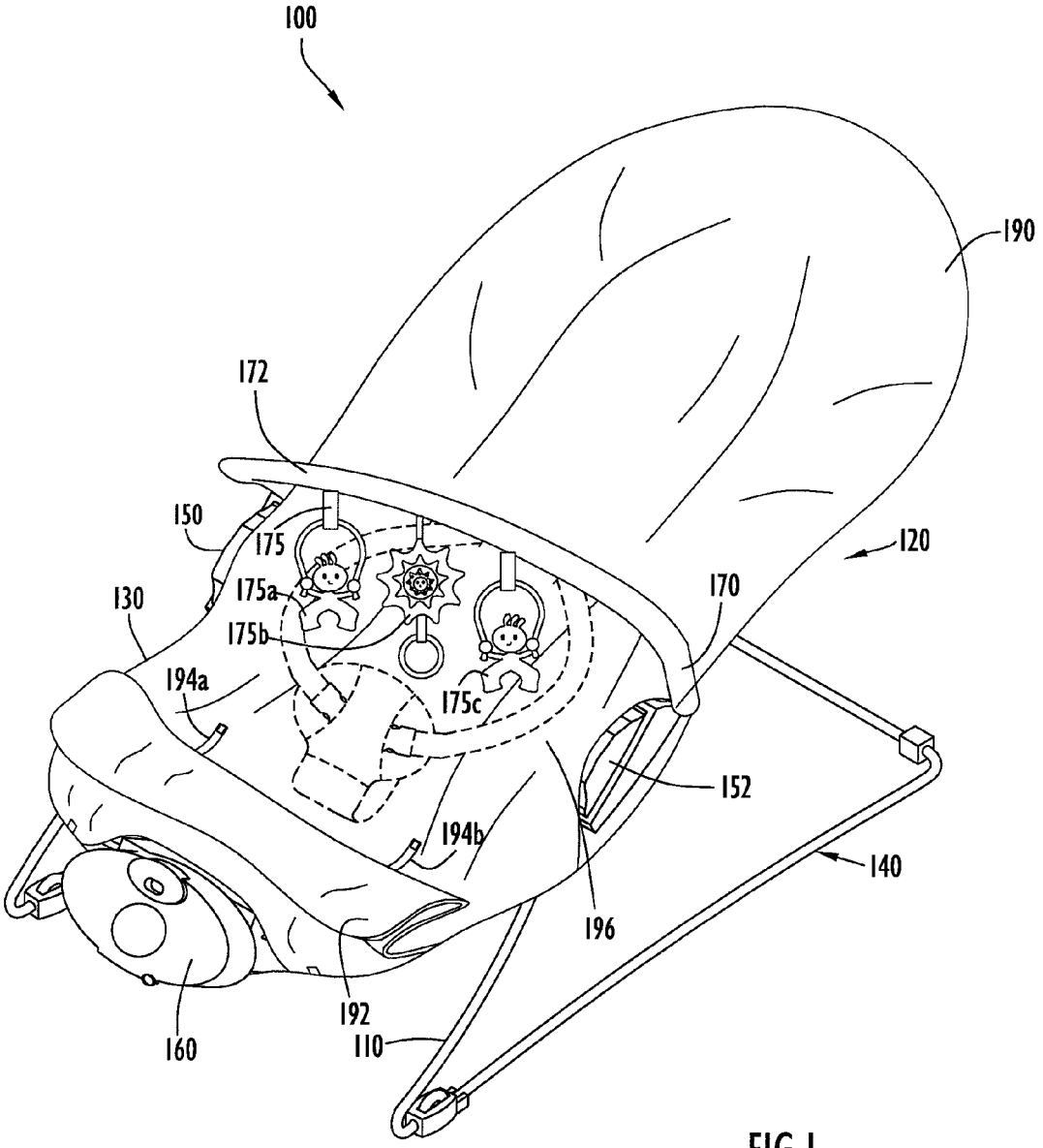
FIG. 1 is a perspective view of an infant bouncer seat (including soft goods) in accordance with the present invention.
Figure 2:
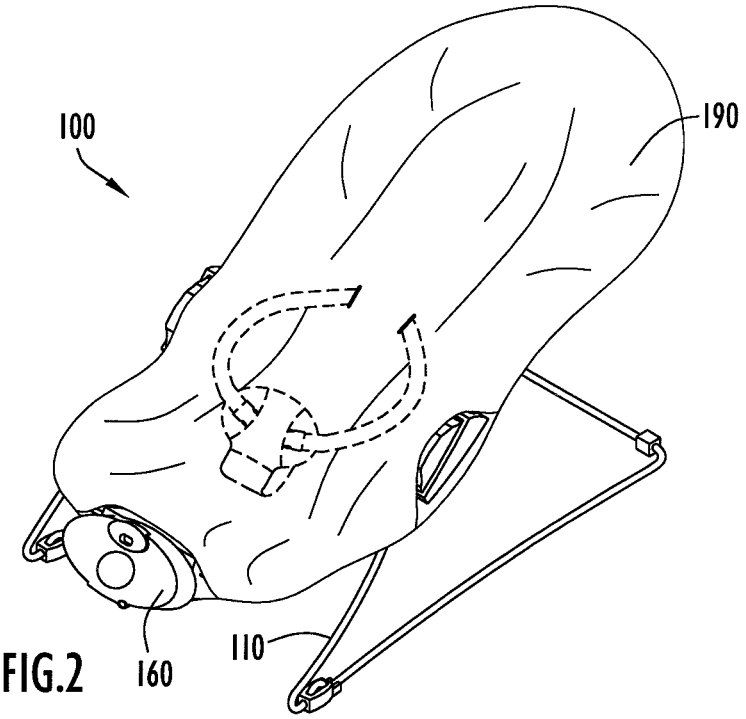
FIG. 2 is a perspective view of the infant bouncer seat of FIG. 1 with the toy bar and blanket removed for clarity.
Figure 3:
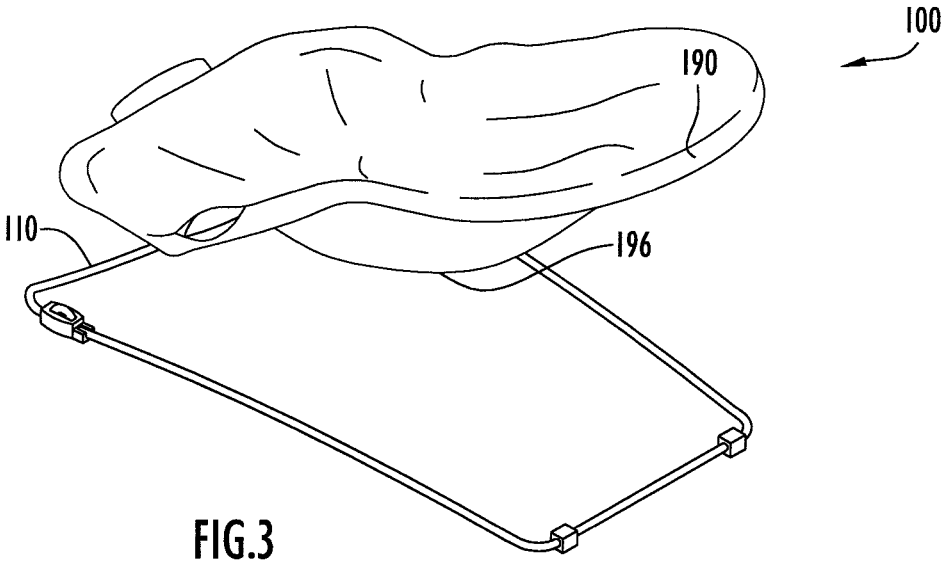
FIG. 3 is a rear perspective view of the infant bouncer seat of FIG. 2.
Figure 4:
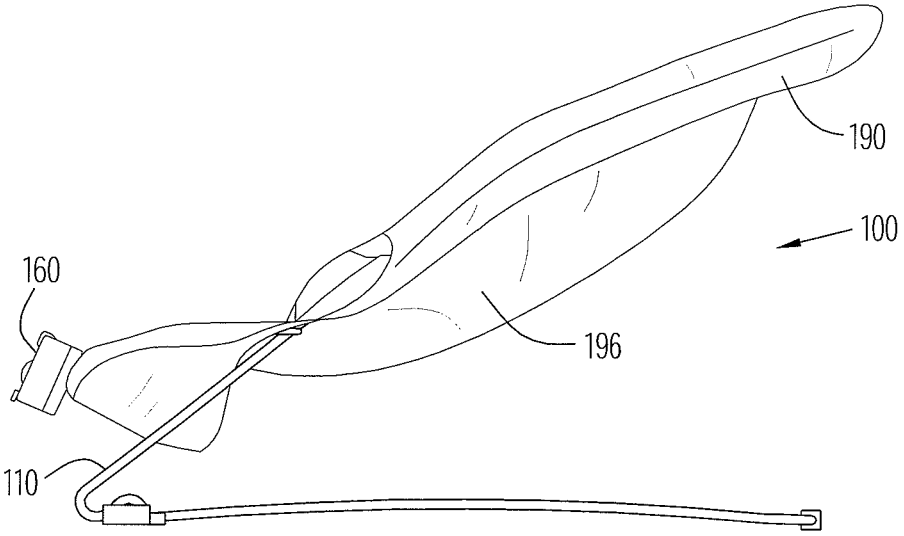
FIG. 4 is a left side view of the infant bouncer seat of FIG. 2.
Figure 5:
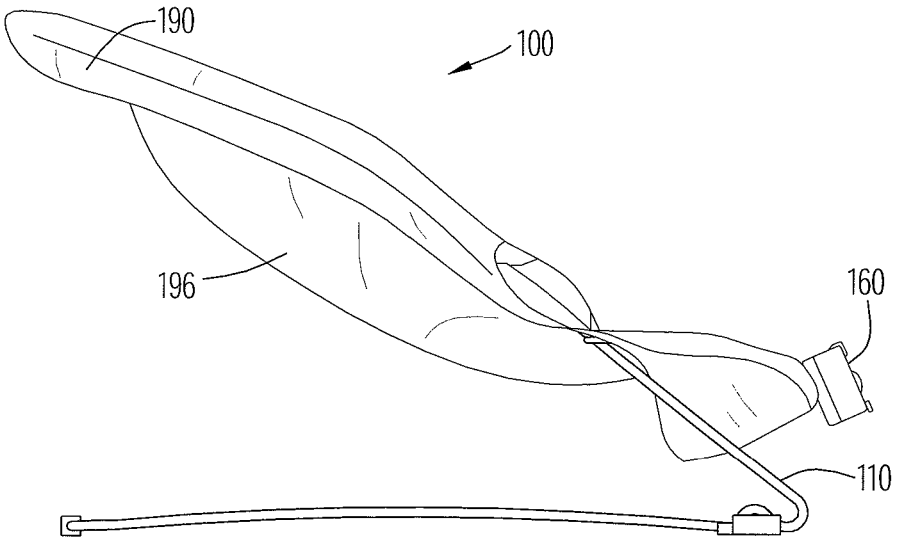
FIG. 5 is a right side view of the infant bouncer seat of FIG. 2.
Figure 6:
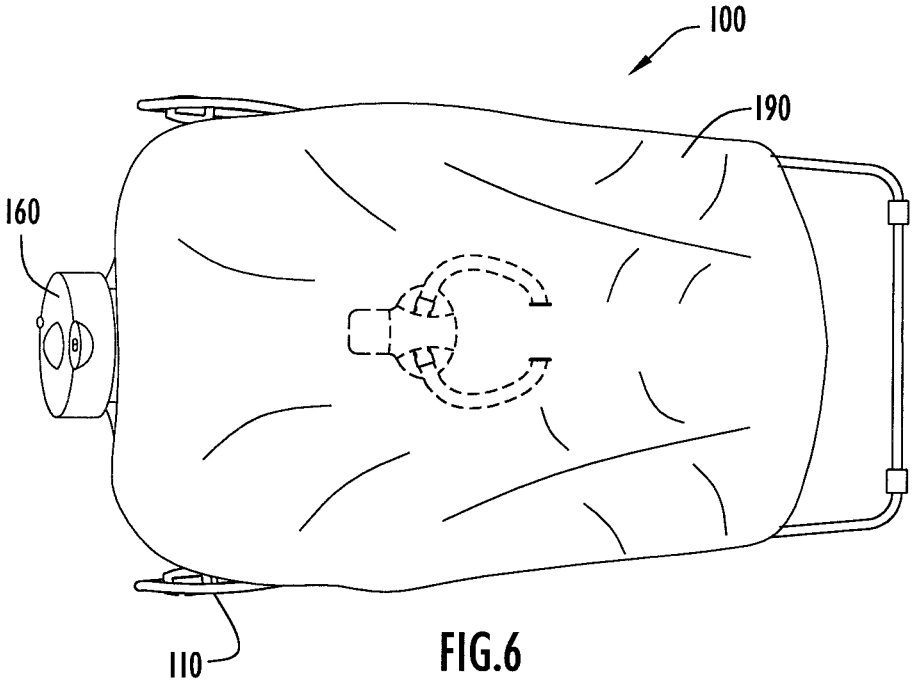
FIG. 6 is a top view of the infant bouncer seat of FIG. 2.
Figure 7:
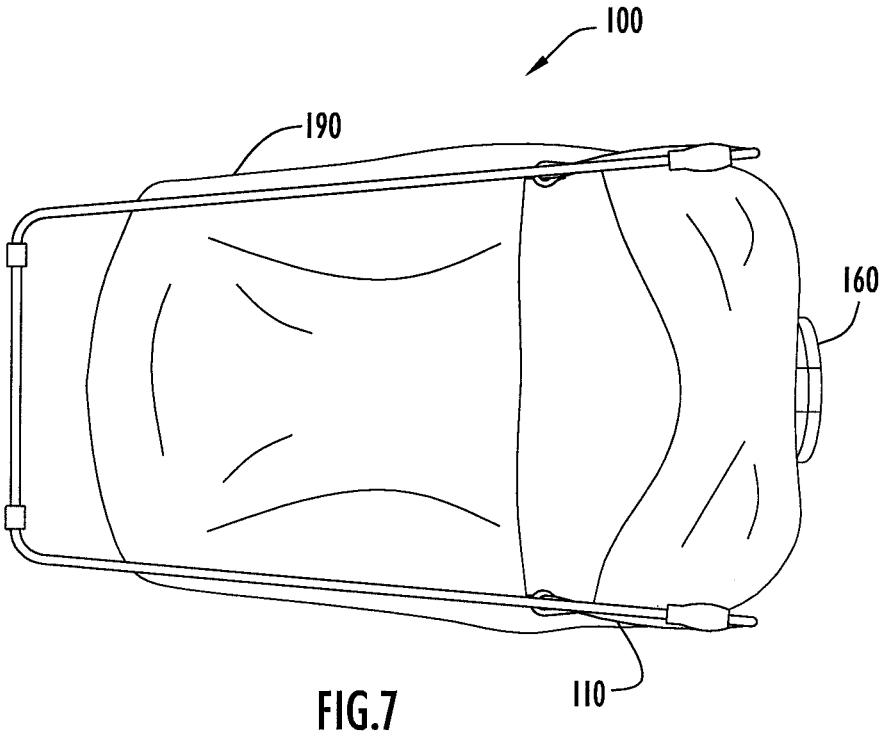
FIG. 7 is a bottom view of the infant bouncer seat of FIG. 2.
Figure 8:
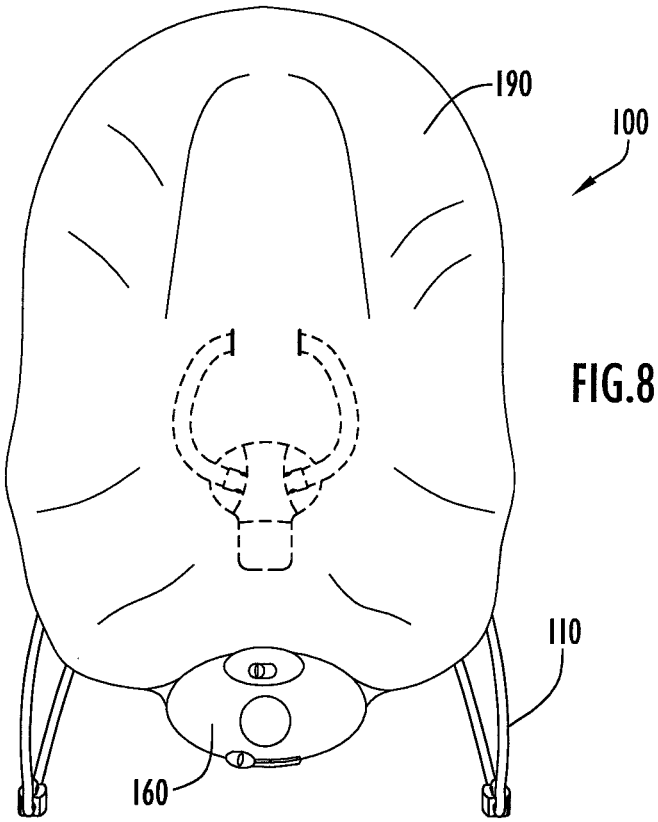
FIG. 8 is a front view of the infant bouncer seat of FIG. 2.
Figure 9:
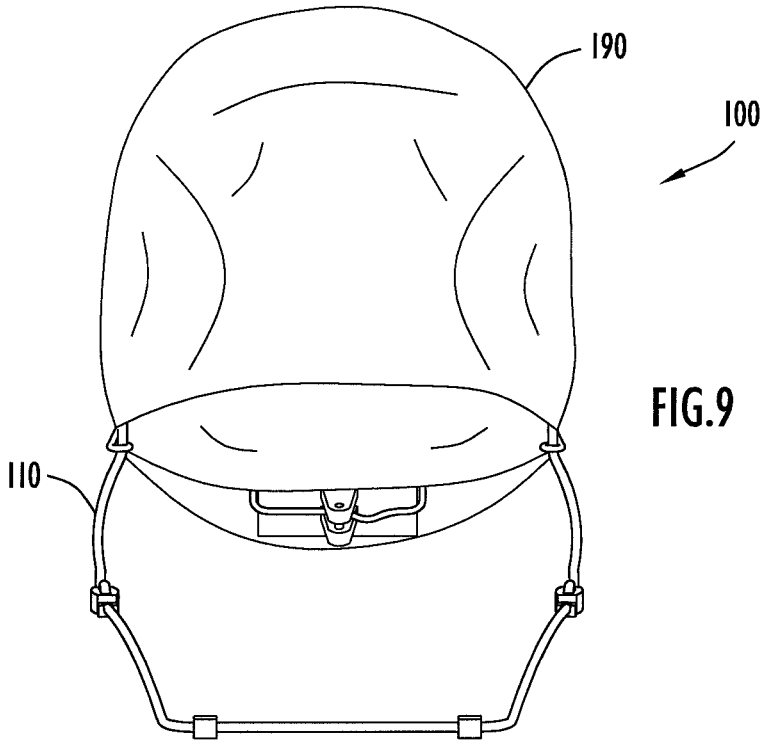
FIG. 9 is a rear view of the infant bouncer seat of FIG. 2.
Figure 10:
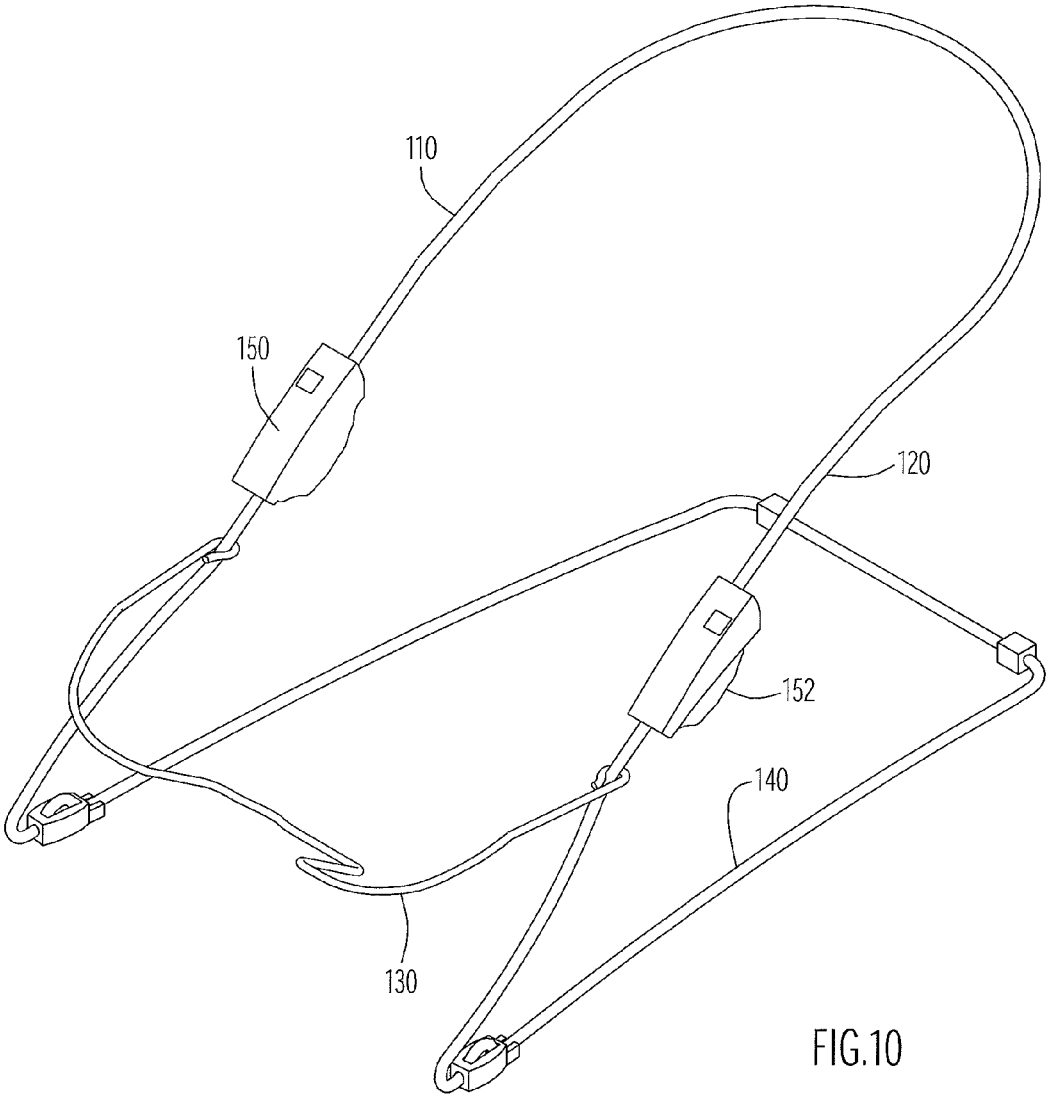
FIG. 10 is a perspective view of a frame of the infant bouncer seat of FIG. 2 with soft goods, sensory stimulus unit, toy bar, and blanket removed for clarity.

Referring to FIGS. 1-9, a bouncer-type infant seat 100, in accordance with the present invention, may include a frame 110 and soft goods 190. Generally, a frame 110 may be formed of metal or any other suitable material, and may include a main portion 120, a front leg portion 130, and a rear base portion 140. Each portion of frame 110 will be described in detail below.

Along each side (right, left) of frame 110, a handle 150, 152 may be included. The handles 150, 152 can assist in providing portability of the infant seat 100, whether the infant is in or out of the seat. Also, on the frame 110, there may be a sensory stimulus/entertainment unit 160. An entertainment unit 160 in accordance with the present invention will be described in detail below.

Infant seat 100 may also include a toy bar 170 (See FIG. 1). Toy bar 170 may be covered with a coordinating soft goods material 172. Each end of toy bar 170 may be inserted into a socket (not shown) on each respective side of frame 110. At least one toy 175 may hang from toy bar 170 at an appropriate height for an infant to interact with the toy 175. For example, as illustrated, two character toys 175*a*, 175*c* hang from the toy bar 170. As shown in FIG. 1, between the two character toys 175*a*, 175*c* hangs a sun-themed toy 175*b*. The sun-themed toy 175*b* includes a sun that may be turned 180° and a pull loop. Each toy 175*a-c* may be removably attached (via a hook and loop type fastener or other appropriate means) to toy bar 170.

Soft goods material 190 may be provided on the frame 110 of the infant seat 100. The soft goods material 190 may be designed to fit securely and snugly on the frame 110. The soft goods material 190 may, for convenience, be removable and washable. Soft goods material 190 may have a themed pattern, for example, such as a brightly colored "happy" sun and smiling moon set on a brightly colored background (described herein as a "Fiesta-Siesta" theme). The soft goods material 190 may also include an attached blanket 192, which can be rolled up and secured with two hook and loop type fasteners 194*a*, 194*b*.

Soft goods material 190 in conjunction with the frame 110 of the infant seat 100 provides a seating portion for an infant. The soft goods material 190 can support the infant in a seated/upright position. As shown in FIGS. 1 and 3-5, the design of the soft goods material 190 in conjunction with the frame 110 of the infant seat 100 of the present invention provides a seat pocket 196 for receiving an infant. As a result, the seat pocket 196 of infant seat 100 of the present invention is deeper, wider, and fuller than the usual seat pocket of a conventional infant bouncer seat, and thus, the uprighted infant can sit more securely within the infant seat 100. This deeper seat pocket 196 also can provide additional space in order for a larger infant to fit within the infant seat 100.

Figure 11:
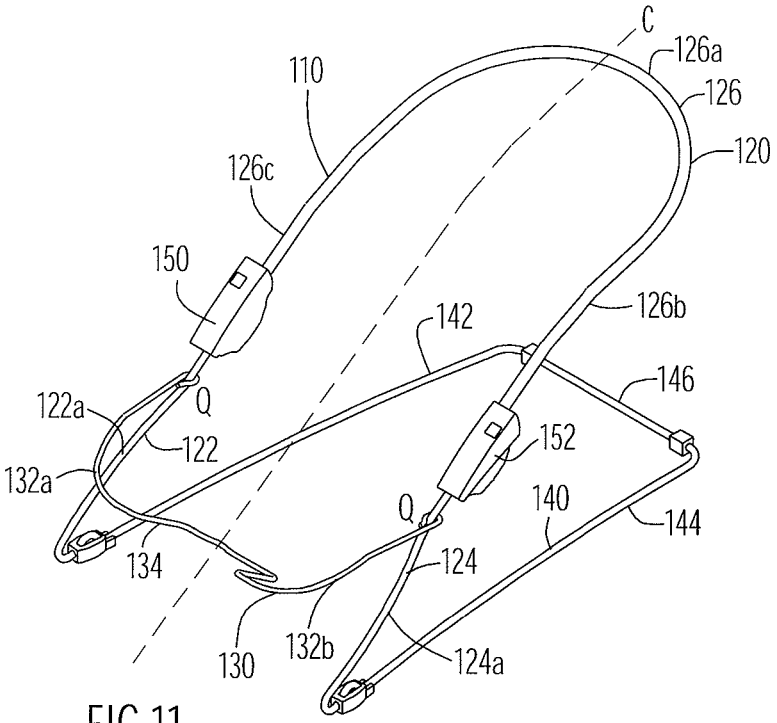
FIG. 11 is a side perspective view of the infant bouncer seat of FIG. 10.
Figure 12:
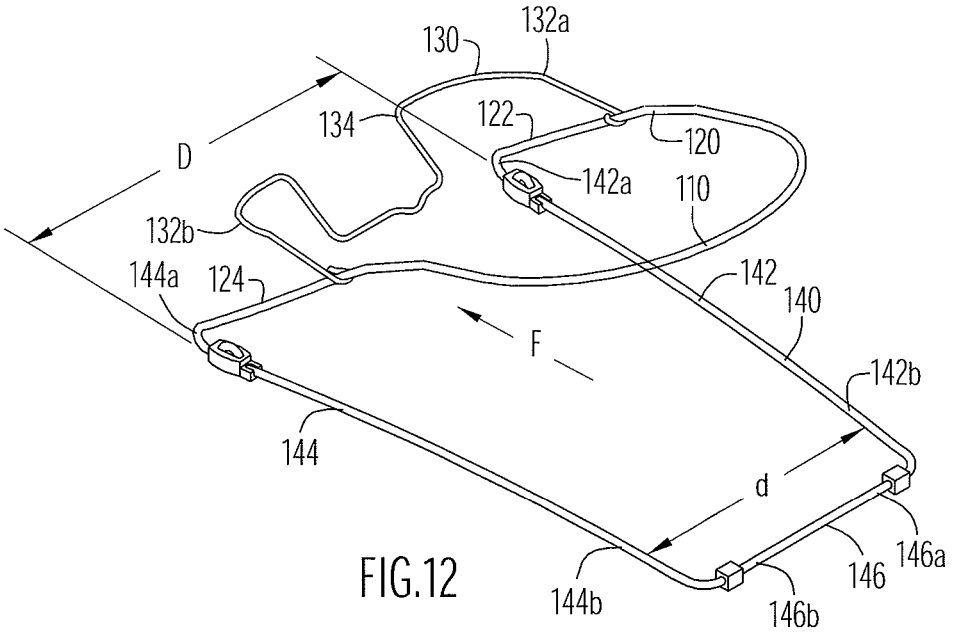
FIG. 12 is a rear perspective view of the infant bouncer seat of FIG. 10.

Referring to FIGS. 10-18, frame 110 may include a main portion 120, a front leg portion 130, and a rear base portion 140. The main portion 120 may have a generally U-shaped configuration. As shown in FIGS. 11 and 12, the main portion 120 may include a right leg portion 122, a left leg portion 124, and a back portion 126.

Back portion 126 forms the bend of the U-shape of the main portion 120 of the frame 110. Back portion 126 may include an upper portion 126*a*, and right and left lower portions 126*c*, 126*b*. Right and left lower portions 126*c*, 126*b* intersect the respective right and left leg portions 122, 124. Upper portion 126*a* may be canted slightly rearward, relative to a plane (see plane X in FIG. 13) extending from the right and left lower portions 126*c*, 126*b* of the back portion 126. This canting can be at an angle of approximately 30°, as shown by Y in FIG. 13. By providing this canting to the upper portion 126*a* of frame 110, the seat pocket 196, provided by the soft goods 190 on frame 110, can be deeper, as compared to conventional infant seats. The deeper seat pocket can provide a bigger place for an infant to be positioned. Also, an infant can be better angled to view ongoing activities and its surroundings.

Right and left leg portions 122, 124 can be arranged at an upward angle, relative to a surface on which the infant seat 100 may be rested. At a central portion 122*a*, 124*a* of each right and left leg portion 122, 124, respectively, the leg portion 122, 124 can bow outward, i.e., away from a central line C of the infant seat, to form a curve in each leg portion 122, 124 (see FIGS. 11, 17, and 18). As shown in FIG. 11, above the central portion 122*a*, 124*a* of each right and left leg portion 122, 124, the leg portions 122, 124 may intersect the back portion 126 of the main portion 120 of the frame 110. Proximate to the leg portion 122, 124 and the back portion 126 intersections, a handle 150, 152 may be disposed. Note that each portion 122, 124, 126 may be formed separately from or integrally with any other part to form the main portion 120 or any other part of frame 110.

Figure 13:
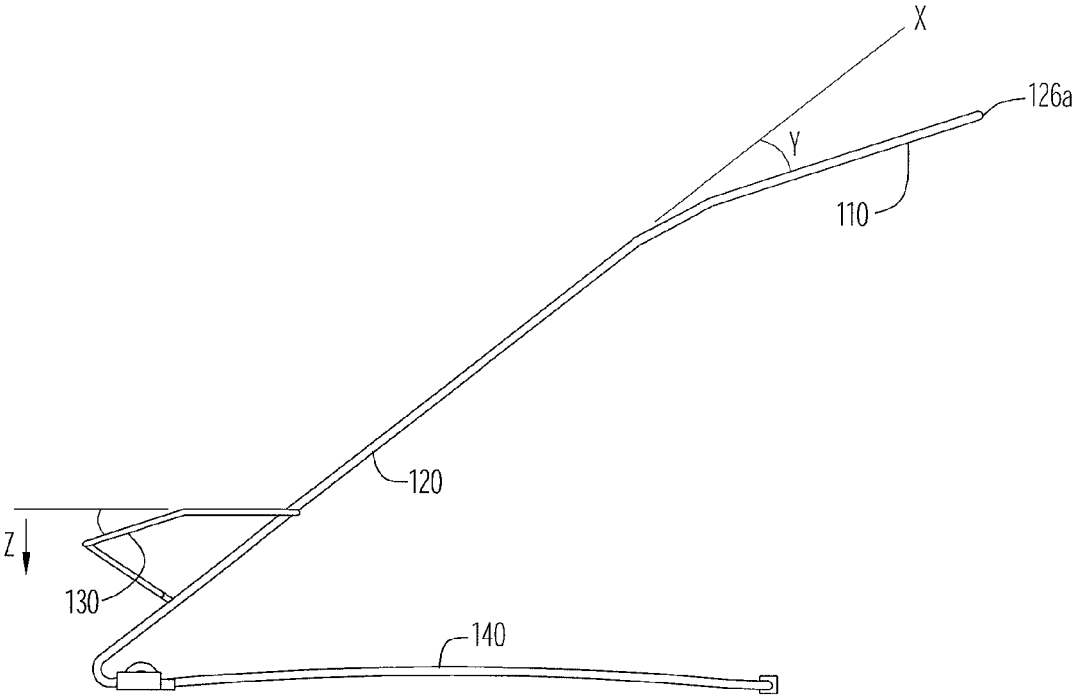
FIG. 13 is a left side view of the infant bouncer seat of FIG. 10.
Figure 14:
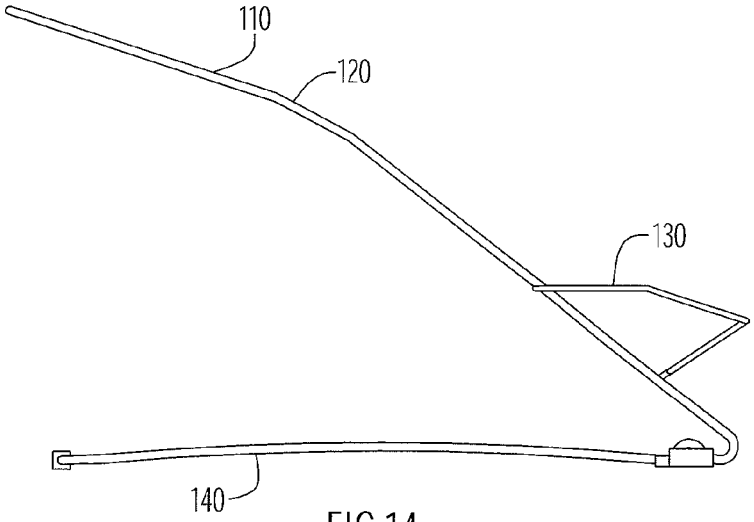
FIG. 14 is a right side view of the infant bouncer seat of FIG. 10.
Figure 15:
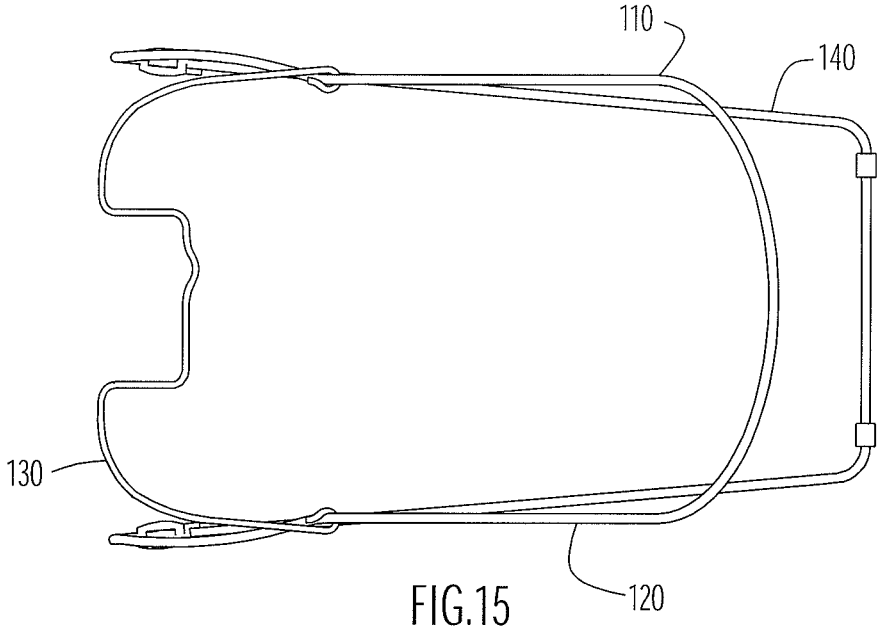
FIG. 15 is a top view of the infant bouncer seat of FIG. 10.
Figure 16:
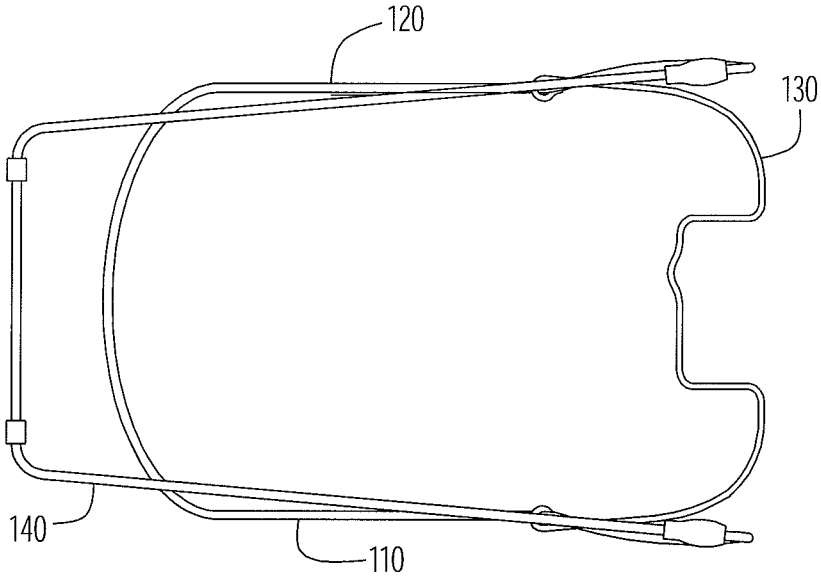
FIG. 16 is a bottom view of the infant bouncer seat of FIG. 10.

As shown in FIGS. 11 and 12, the front leg portion 130 may include right and left side portions 132*a*, 132*b*, and a front portion 134. The front leg portion 130 may be generally U-shaped with an indented section to support the sensory stimulus/entertainment unit 160. The front leg portion 130 may extend forward, and can be slightly angled downward with respect to the back portion 120 of frame 110, in the direction of Z as shown in FIG. 13. Front leg portion 130 can be also rotatably movable with respect to back portion 120 of frame 110 (at points labeled Q in FIG. 11) so as to provide for folding of the frame 110 and attachment of the soft goods material 190. Also, a sensory stimulus/entertainment unit 160 may be disposed on the front leg portion 130, as seen in FIG. 1. By having the front leg portion 130 angling slightly downward, the seat pocket 196, provided by the soft goods 190 on frame 110, can be deeper and more secure, as compared to conventional infant seats. The deeper seat pocket may provide more space for an infant to be positioned. Also, an infant can be better angled to view the ongoing activities within its surroundings.

Figure 17:
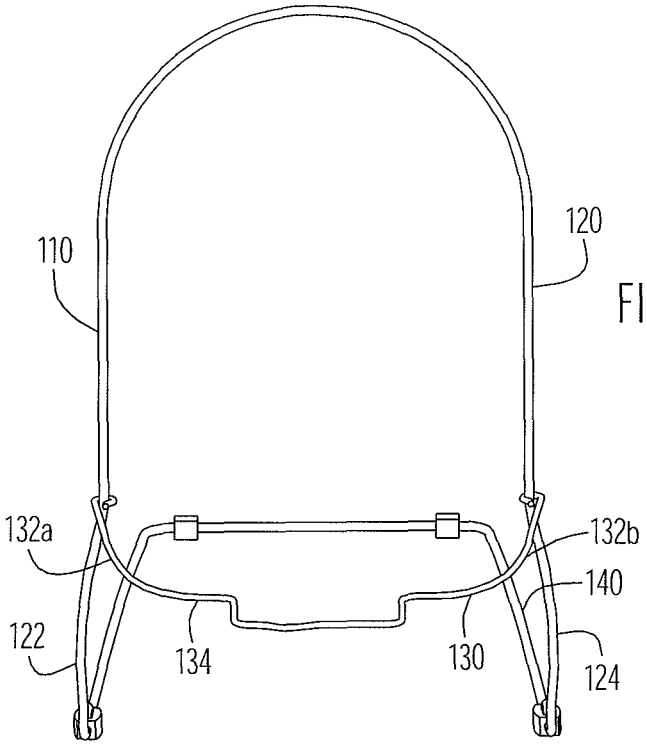
FIG. 17 is a front view of the infant bouncer seat of FIG. 10.
Figure 18:
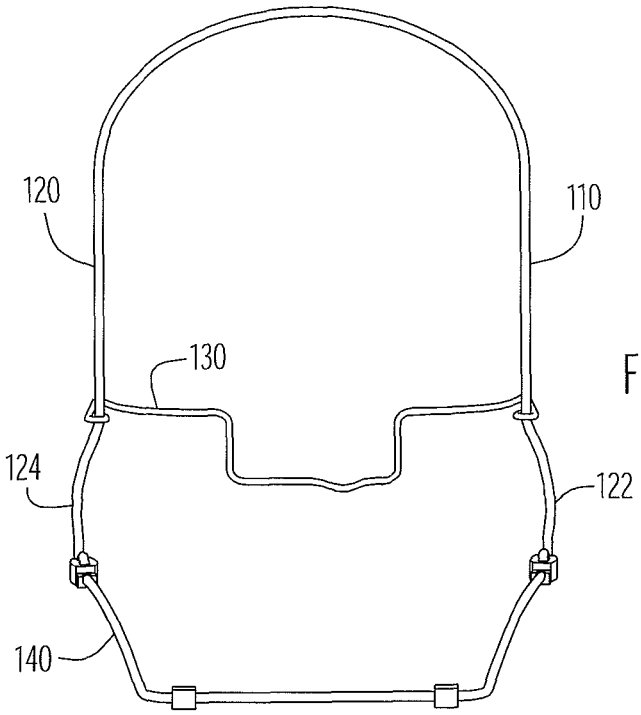
FIG. 18 is a rear view of the infant bouncer seat of FIG. 10.

Right and left side portions 132*a*, 132*b* of front portion 134 may extend from back portion 120 of frame 110 substantially in parallel, as each side portion 132*a*, 132*b* curves inward from back to front, i.e., toward the central line C of the infant seat, as shown in FIGS. 11 and 17. Right and left side portions 132*a*, 132*b* intersect the front portion 134 of front leg portion 130. Note that each portion 132*a*, 132*b*, 134 may be formed separately from with or integrally with any other part to form the front leg portion 130 or any other part of frame the 110.

As shown in FIGS. 11 and 12, rear base portion 140 may be substantially U-shaped. Rear base portion 140 may include a right base portion 142, a left base portion 144, and a back base portion 146. Right base portion 142 and left base portion 144 may extend forwardly i.e., toward the front of the infant seat, in the direction designated by F in FIG. 12, from back base portion 146. At respective front portions 142*a*, 144*a*, right and left base portions 142, 144 may intersect right and left leg portions 122, 124 of main portion 120 of frame 110, respectively. At this intersection, a distance D between the front portions 142*a*, 144*a* of each of the right and left base portions 142, 144 may be greater than a distance d between rear portions 142*b*, 144*b* of each of the right and left base portions 142, 144. At respective rear portions 142*b*, 144*b*, right and left base portions 142, 144 may intersect each end 146*a*, 146*b* of back base portion 146. Back base portion 146 may be substantially horizontal, and oriented substantially perpendicular to right and left base portions 142, 144. By having the distance D between the front portions 142*a*, 144*a* of each of the right and left base portions 142, 144 be greater than a distance d between rear portions 142*b*, 144*b* of each of the right and left base portions 142, 144, the seat pocket 196, provided by the soft goods 190 on frame 110, can be deeper and more secure, as compared to conventional infant seats. Note that each portion of the rear base portion 140, 142, 144, 146 may be formed separately from or integrally with any other part to form the rear base portion 140 or any other part of frame 110.

As described briefly above, the infant seat 100 may include a sensory stimulus/entertainment unit 160 disposed on the front leg portion 130 of the frame 110 of the infant seat (see FIG. 1). The entertainment unit 160 may provide amusement to an infant through, for example, a variety of outputs, i.e., sensory stimuli, and changes provided thereon. The entertainment unit 160 may, for example, follow a themed pattern, such as Fiesta-Siesta to coordinate with the theme of the soft goods material 190. As shown in FIGS. 19-27B, a slide switch 520 may be mounted on an entertainment unit 160. The slide switch 520 can effectuate a change in visual appearance and a corresponding change in sensory output, i.e., sensory stimulus of the entertainment unit 160.

Figure 19:
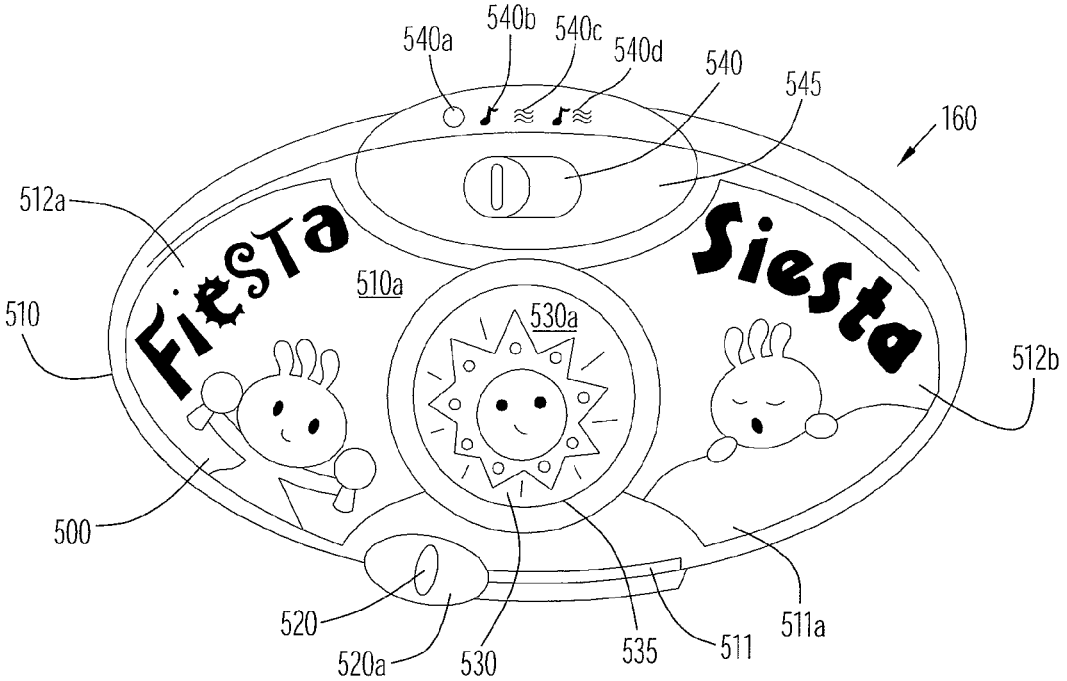
FIG. 19 is a front view of the sensory stimulus unit of the present invention, showing a first visual appearance including an exemplary embodiment of a slide switch showing a first visual appearance.

Referring to FIG. 19, an entertainment unit 160 may be mounted on a juvenile product (swing, bassinet, bouncer seat, car seat, high chair, etc.) and may include a control panel 500. Control panel 500 may include a housing 510 that has a slide switch 520, a mode indicator ball 530, and a slide switch opening 535. Housing 510 may also include a faceplate portion 510*a* and an outer casing 550 (see FIGS. 21, 22, 25, and 26). The faceplate portion 510*a* may have a visually appealing shape and may include a groove 511 formed integrally therein. Groove 511 may be disposed proximate to a lower edge portion 511*a* of the faceplate portion 510*a* of the housing 500. Slide switch 520 may be adapted to move transversely along groove 511. Slide switch 520 may be formed to be grasped by a user's thumb and/or forefinger and be manipulated along groove 511.

Figure 20:
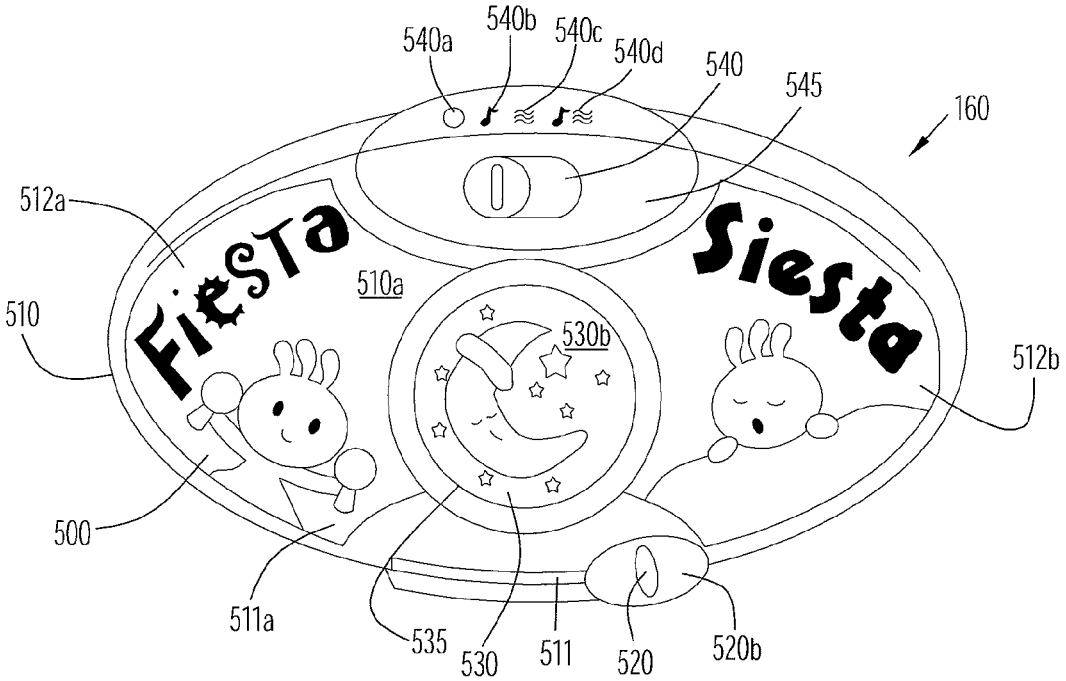
FIG. 20 is a front view of the sensory stimulus unit of FIG. 19, showing a second visual appearance.
Figure 21:
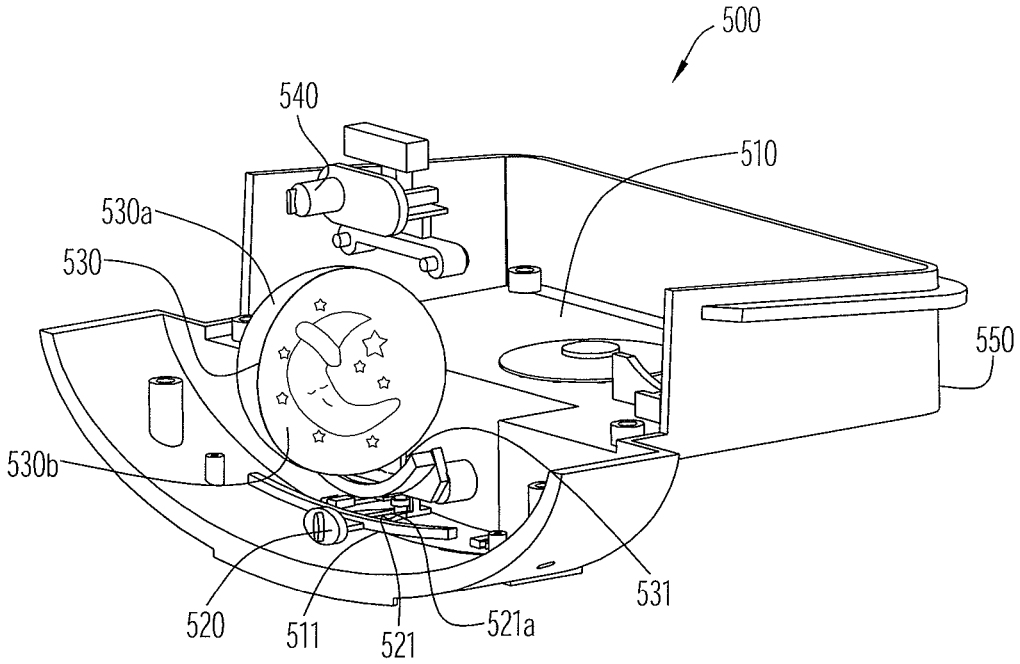
FIGS. 21 and 22 are side views of the ball disposed within the sensory stimulus unit housing of FIG. 19 and the slide switch with the faceplate portion of the housing removed.

Opening 535 may have a circular shape and may be formed integrally with faceplate portion 510*a* of housing 510. Opening 535 may be adapted to rotatably retain mode indicator ball 530 therein. Mode indicator ball 530 may be shaped like a sphere and may have at least one visual indicia 530*a*, 530*b* provided thereon. For example, mode indicator ball 530 may have, as shown in FIG. 19, a "happy" sun indicia 530*a*, and as shown in FIG. 20, a "sleepy" moon indicia 530*b*. The visual indicia 530*a*, 530*b* of mode indicator ball 530 may be painted, molded, or otherwise attached to or formed thereon. For example, the indicia 530*a*, 530*b* of mode indicator ball 530 may be molded integrally with mode indicator ball 530.

Control panel 500 can also include an operational control unit 545 that may include a switch 540 to select an operational state. For example, as shown in FIG. 19, the switch 540 may select one of four operational states: "power off" state 540*a*, "music only" state 540*b*, "vibration only" state 540*c*, and "music and vibration" state 540*d*. As illustrated herein, entertainment unit 160 may optionally include other components, such as an audio generating unit and a vibration generating unit, as appropriate or desired.

In use, generally, when a user places slide switch 520 into position 520*a*, a first visual indicia is be displayed by mode indicator ball 530 and sensory output, i.e., sensory stimulus, such as music corresponding to the first visual indicia 530*a*, is generated. When a user moves slide switch 520 into position 520*b*, mode indicator ball 530 is rotated to display a second, different, visual indicia 530*b* and a second, different, sensory output, i.e., sensory stimulus, corresponding to the second visual indicia 530*b*, is generated.

More particularly, when, as shown in FIG. 19, a user moves slide switch 520 along groove 511 towards a first side 512*a* of housing 510 to position 520*a*, mode indicator ball 530 is rotated to display a first visual indicia 530*a*, i.e., "happy" sun, and, when mode indicator ball 530 displays the first visual indicia, an output, i.e., sensory stimulus, generator (not shown), i.e., an audio generating unit, provides corresponding output, for example, lively, upbeat music to entertain the user as well as the infant received in the juvenile product. When a user moves slide switch 520 towards a second side 512*b* of housing 510 to position 520*b*, mode indicator ball 530 is rotated to display a second, different, visual indicia 530*b*, i.e., "sleepy" moon, as shown in FIG. 20, and, when mode indicator ball 530 displays the second visual indicia, the output generator, i.e., the audio generating unit, provides corresponding output, for example, quiet, sleepy music to soothe the user and the infant received in the juvenile product.

FIGS. 21-26 depict the detailed interaction between mode indicator ball 530 and slide switch 520 within the control panel housing 510 when slide switch 520 is actuated. Slide switch 520 may be moved transversely along groove 511 of housing 510. Housing 510 may also include a grooved component 521 (shown in more detail in FIGS. 24 and 25), which extends rearward, towards the back of housing 510 of control panel 500. Grooved component 521 may include a groove 521*a* formed therein. Mode indicator ball 530 may include an extension or raised boss 531 that is adapted to move within groove 521*a* of component 521. Extension 531 may include a biasing member 532 that helps ensure that the mode indicator ball 530 rotates a full 180° and that the slide switch 520 moves completely to the left or right upon actuation. The biasing member 532 may comprise a steel spring or a torsion spring, or any other appropriate biasing member. One end 531*a* of the biasing member may be provided in a groove on extension 531. A second end 531*b* of the biasing member may be provided on a knob 533 (see FIG. 23) located on a lower side of the face plate. Biasing member 532 extends between extension 531 and knob 533. Note that the slide switch 520 may still move along groove 511 and rotate mode indicator ball 530, even if there is biasing member.

When slide switch 520 is actuated, i.e., moved transversely along groove 511 of housing 510, grooved component 521 is translated causing extension 531 to move within groove 521*a*, and mode indicator ball 530 is rotated about a fixed vertical axis to change its visual appearance. More particularly, when switch 520 is moved in direction of arrow R in FIG. 22, grooved component 521 also moves in direction R, extension 531 is moved within groove 521*a* of grooved component 521, and mode indicator ball 530 is thus rotated in the direction of arrow X to display the second visual indicia 530*b*.

Figure 22:
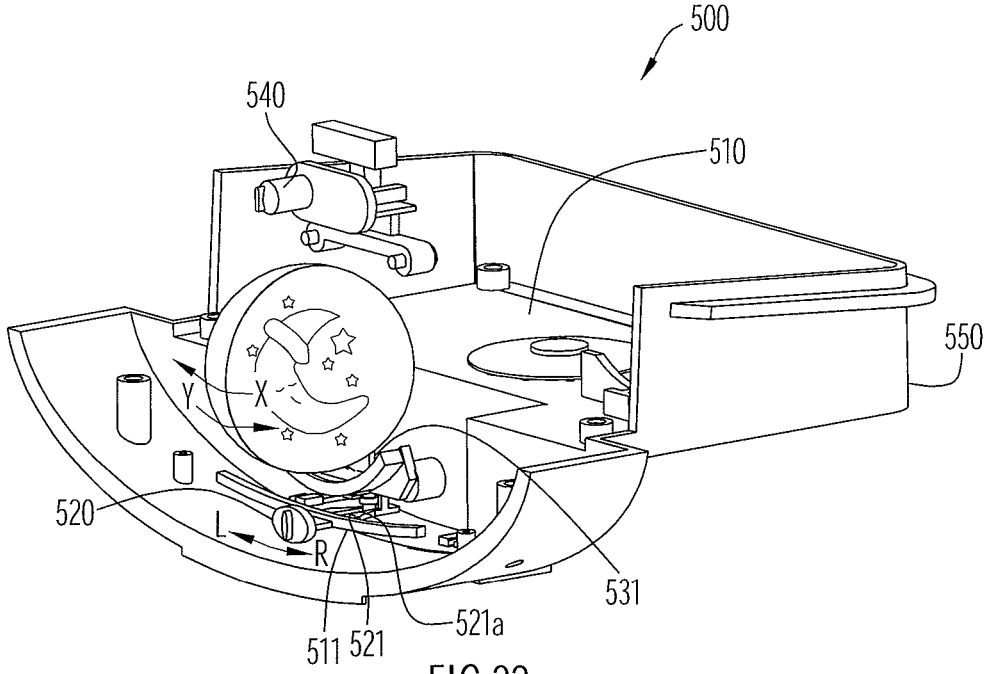
Figure 23:
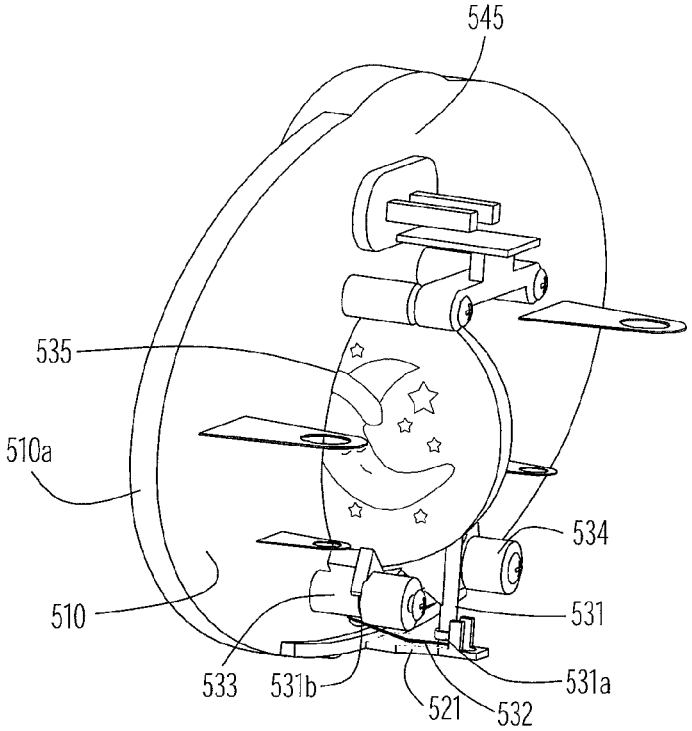
FIG. 23 is a side view of the ball disposed within the sensory stimulus unit housing in relation to the faceplate portion of the housing.
Figure 24:
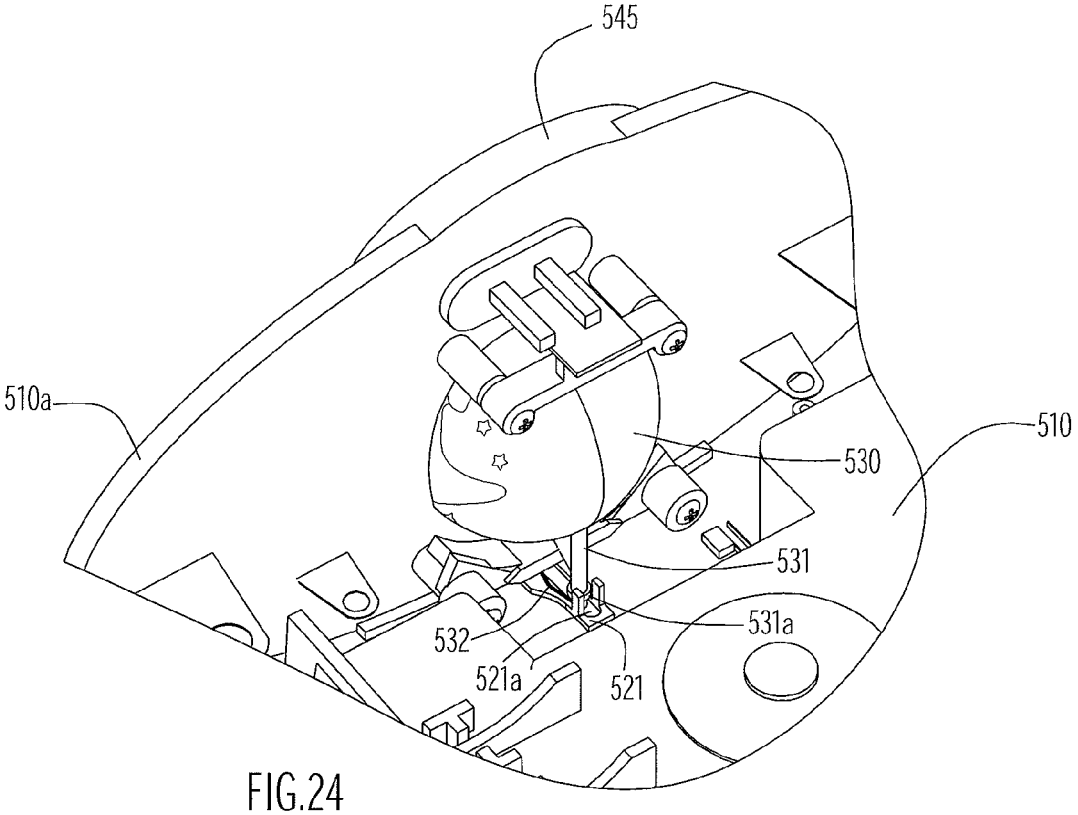
FIGS. 24-26 are various views of the ball within the sensory stimulus unit housing in relation to the slide switch of FIG. 19.
Figure 25:
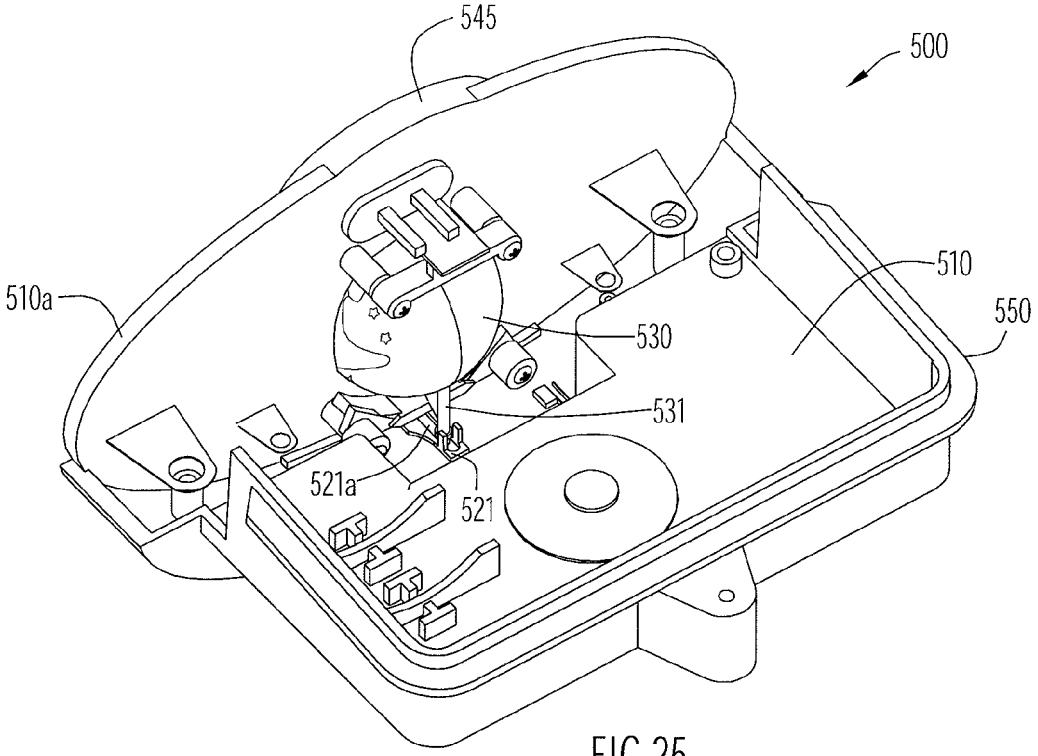
Figure 26:
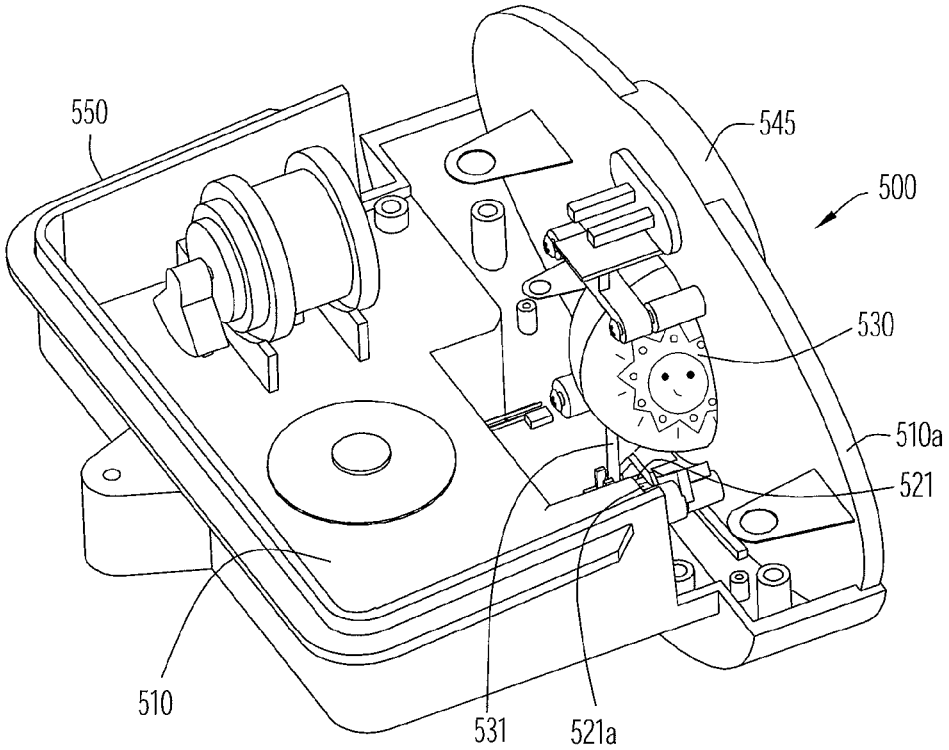

Alternatively, when slide switch 520 is moved in the direction of arrow L in FIG. 22, grooved component 521 also moves in direction L, extension 531 is moved within groove 521*a* of grooved component 521, and mode indicator ball 530 is thus rotated in the direction of arrow Y to display the first visual indicia 530*a*. When slide switch 520 reaches position 520*a* or 520*b* and the respective visual indicia is displayed. Also, when slide switch 520 reaches position 520*a* or 520*b* electrical contact is made proximate knobs 533, 534 and the electronic portion of the entertainment unit 160 causes the output corresponding to the displayed visual indicia to be generated. Thus, movement of slide switch 520 to positions 520*a* or 520*b* not only rotates the mode indicator ball 530, but also electrically communicates with the controller (not shown) to causes the output corresponding to the displayed visual indicia to be generated.

Figure 27A:
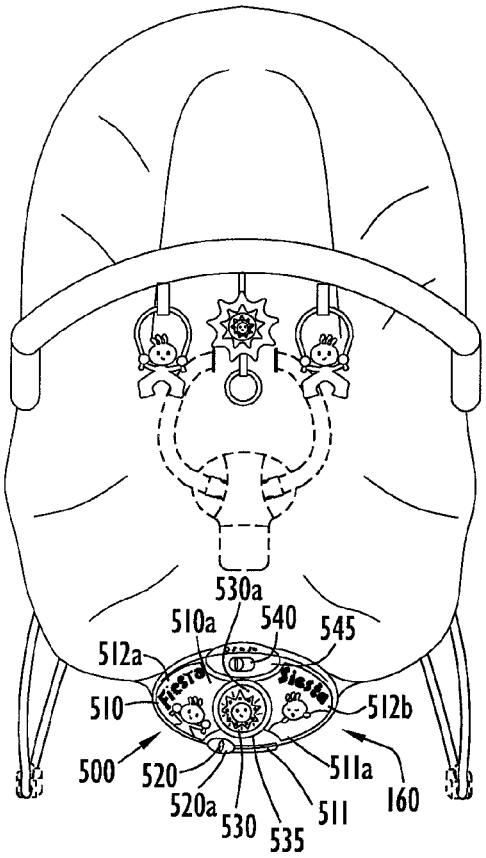
FIGS. 27A and 27B illustrate front views of the exemplary embodiment of the sensory stimulus unit of FIGS. 19 and 20 in use with an infant seat.
Figure 27B:
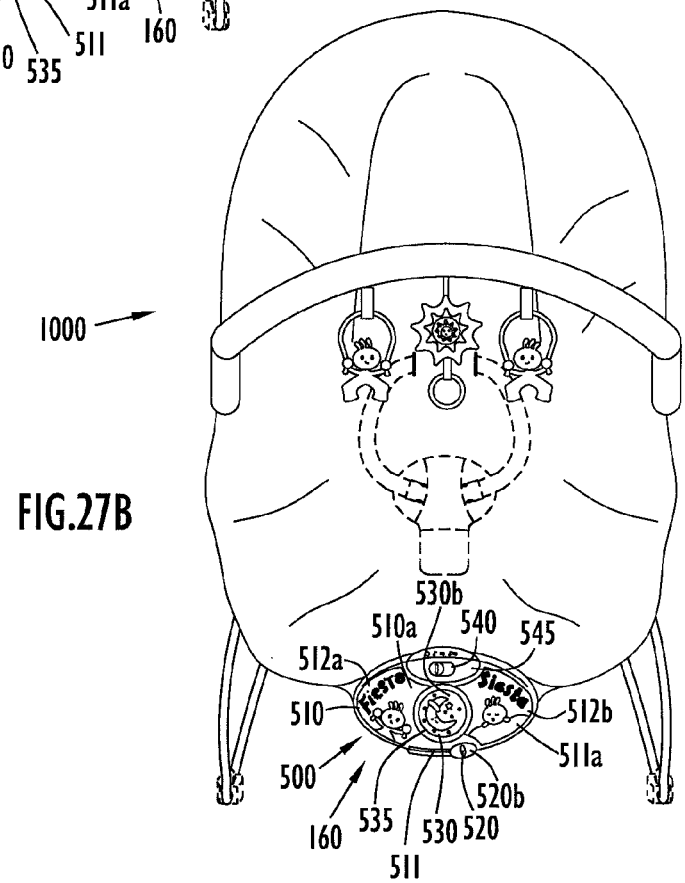

Referring to FIGS. 27A and 27B, for example, the entertainment unit 160 with the slide switch 520 described above may be used with a juvenile product, such as a bouncer seat 1000. The control panel 500 including slide switch 520 may be connected to the frame of the bouncer seat 1000, for example, on the portion of the bouncer seat frame providing leg support to the infant received therein. In this example, the bouncer seat 1000 has a Hispanic themed design and includes a conventional audio output generating unit (not specifically illustrated) and a conventional vibration generating unit (not specifically illustrated). The audio output generated can be lively, "fiesta" type music or quiet, "siesta" type music. The control panel 500 also includes an operational control unit 545 that includes a switch 540 to select an operational state. The switch 540 selects one of four operational states: "off" 540*a*, "music only" 540*b*, "vibration only" 540*c*, and "music and vibration" 540*d*.

As illustrated in FIGS. 19 and 20, for only music to play, the operational control switch 540 is set to "music only" position 540*b*. When, as shown in FIG. 27A, slide switch 520 is moved to the "fiesta" side 512*a* of housing 510 in position 520*a*, mode indicator ball 530 displays a "happy" sun face, first indicia 530*a*, and the audio generating unit provides lively music to entertain the user and the infant received in the bouncer seat 1000. Slide switch 520 may be moved to the "siesta" side 512*b* of housing 510 to position 520*b*. Mode indicator ball 530 rotates to display a "sleepy" moon, second visual indicia 530*b*, as shown in FIG. 27B, and the audio generating unit provides quiet, sleepy music to soothe the user and the infant received in the bouncer seat 1000. Other themed designs and corresponding output may be used without departing from the scope and spirit of the invention.

While the invention has been described in detail and with reference to specific embodiments thereof, it will be apparent to one skilled in the art that various changes and modifications can be made therein without departing from the spirit and scope thereof. For example, the slide switch may be used with a variety of products, including, but not limited to juvenile products (as described above) or a toy product. Also, for example, the corresponding output may include sensory stimulus in addition to or in the alternative to audio output. Other outputs may include visual or tactile or motion output, such as lights or texture change or vibration. Accordingly, it is intended that the present invention covers the modifications and variations of this invention provided they come within the scope of the appended claims and their equivalents.

We claim:

1. A control device for an entertainment unit mounted on a frame of an infant seat, the control device comprising:

an engagement portion coupling the control device and the entertainment unit to the frame of the infant seat in proximity to a infant receiving portion of the infant seat, the control device facing away from the infant receiving portion;

an output generator configured to produce a plurality of output modes including at least a first output mode and a second output mode;

a mode selection switch operatively coupled to the output generator and operable to select a particular output mode from the plurality of output modes, the mode selection switch being repositionable from a first switch position to a second switch position; and a repositionable indicator operable to visually indicate the particular output mode selected by the mode selection switch, the repositionable indicator being located separately from the mode selection switch and coupled to the mode selection switch via a mechanical linkage, wherein repositioning of the mode selection switch from the first switch position to the second switch position (a) moves the indicator from a first indicator position to a second indicator position and (b) changes the generated output mode from the first output mode to the second output mode, and wherein repositioning of the mode selection switch from the second switch position to the first switch position (c) moves the indicator from the second indicator position to the first indicator position and (d) changes the generated output mode from the second output mode to the first output mode.

2. The control device of claim 1, wherein:

the repositionable indicator comprises a first set of indicia and a second set of indicia;

in the first switch position, only the first set of indicia is viewable by an operator; and in the second switch position, only the second set of indicia is viewable by the operator.

3. The control device of claim 2, wherein the mode selection switch comprises a translating slide switch.

4. The control device of claim 1, wherein repositioning of the mode selection switch from the first switch position to the second switch position rotates the indicator from the first indicator position to the second indicator position.

5. The control device of claim 1, wherein output generated in the particular output mode corresponds to indicia displayed by the indicator.

6. The control device of claim 1, wherein output produced by the output generator is auditory.

7. The control device of claim 1, wherein translational displacement of the mode selection switch rotates the indicator about an axis from the first indicator position to the second indicator position.

8. The control device of claim 7, wherein the translational displacement of the mode selection switch rotates the indicator 180°.

9. The control device of claim 1, wherein the repositioning of the mode selection switch reorients the mechanical linkage and the reorienting of the mechanical linkage repositions the indicator.

10. The control device of claim 9, wherein:

the mechanical linkage includes a groove; and the indicator includes an extension adapted to move within the groove.

11. The control device of claim 10, wherein:

the indicator comprises a ball; and repositioning of the mode selection switch translates the mechanical linkage, which, in turn, moves the extension within the groove to rotate the indicator ball about a fixed vertical axis to change its visual appearance.

12. The control device of claim 1 further comprising an electrical contact operable to electrically communicate with the output generator such that, when contacted by the mode selection switch, the electrical contact generates a signal configured to change the output mode of the control device.

13. A control device for an entertainment unit mounted on a frame of an infant seat, the entertainment unit configured to produce sensory stimulating output, the control device comprising:

means for coupling the control device and the entertainment unit to the frame of the infant seat in proximity to a infant receiving portion of the infant seat, the control device facing away from the infant receiving portion;

means for generating a plurality of output modes, including at least a first output mode and a second output mode;

means for selecting a particular output mode, the selecting means being repositionable from a first position to a second position;

means for visually indicating a selected output mode, the indicating means being repositionable from a first indicating position to a second indicating position; and means for mechanically linking the means for selecting to the means for visually indicating, wherein repositioning the means for selecting from the first position to the second position reorients the means for visually indicating from the first indicating position to the second indicating position, and changes the generated output mode from the first output mode to the second output mode, and wherein repositioning the means for selecting from the second position to the first position moves the means for visually indicating from the second indicating position to the first indicating position and changes the generated output mode from the second output mode to the first output mode.

14. The control device of claim 13, wherein the plurality of output modes comprise electronic modes and wherein output generated in the selected output mode corresponds to indicia displayed by the means for visually indicating.

15. The control device of claim 13, wherein the means for selecting comprises a switch that translates from the first position to the second position, and wherein translational displacement of the means for selecting rotates the means for visually indicating from the first indicating position to the second indicating position.

16. The control device of claim 15, wherein the translational displacement of the means for selecting rotates the means for visually indicating 180°.

17. The control device of claim 13, wherein repositioning the means for selecting reorients the means for mechanically linking and the reorientation of the means for mechanically linking repositions the means for visually indicating.

18. The control device of claim 13, wherein the means for mechanically linking comprises a component having a groove and wherein the means for visually indicating includes an extension adapted to move within the groove.

19. The control device of claim 13 further comprising an electrical contact configured to electrically communicate with the means for generating, the electrical contact generating a signal operable to change the output mode of the control device.

20. The control device of claim 13, wherein the means for visually indicating comprises a first set of indicia and a second set of indicia, and wherein in the first indicating position, only the first set of indicia is visible to an operator and in the second indicating position, only the second set of indicia is visible to an operator.

* * * * *